United States Patent [19]

Gothard et al.

[11] 4,102,678

[45] Jul. 25, 1978

[54] METAL COATING BY A POWDER METALLURGY TECHNIQUE

[75] Inventors: David Olen Gothard; Gary Rudolph Strobel, both of Huntington, W. Va.

[73] Assignee: Huntington Alloys, Inc., Huntington, W. Va.

[21] Appl. No.: 728,780

[22] Filed: Oct. 1, 1976

[51] Int. Cl.[2] ..... B22F 3/00

[52] U.S. Cl. ..... 427/191; 75/208 R; 75/DIG. 1; 427/347; 427/383 C; 427/192; 427/174; 427/357; 427/375; 427/201; 75/208 CS

[58] Field of Search ..... 75/208 R, 208 CS, DIG. 1; 427/347, 383, 191, 192, 174, 357, 375

[56] References Cited

U.S. PATENT DOCUMENTS

| | | | |
|---|---|---|---|
| 2,840,890 | 7/1958 | Emm | 29/180 |
| 2,842,440 | 7/1958 | Hachtman et al. | 75/DIG. 1 |
| 3,150,974 | 9/1964 | Lund et al. | 75/208 CS |
| 3,389,455 | 6/1968 | Clark | 75/208 CS |
| 3,749,558 | 7/1973 | Dillenschneider | 29/191.6 |

OTHER PUBLICATIONS

Jackson, The Elphal Process a New Method of Coating ....Transactions of Institute of Metal Finishing, vol. 40, 1963, pp. 1–5.

*Primary Examiner*—Brooks H. Hunt
*Attorney, Agent, or Firm*—Ewan C. MacQueen; Raymond J. Kenny; Walter A. Petersen

[57] ABSTRACT

A method for coating a metal wire with a thin layer of a second powdered metal. A metal flake powder having a residual surface lubricant from a prior milling operation is placed in the lubricant holding box of a conventional draw bench. The wire to be coated is passed through the metal flake powder and drawn through a conventional drawing die to provide a green-coat wire having a mechanically adherent metal flake powder coating. The green-coat wire is subsequently sintered to metallurgically bond the coating to the wire surface.

8 Claims, No Drawings

METAL COATING BY A POWDER METALLURGY TECHNIQUE

The present invention is directed to a process for coating the surface of a metal wire with a second metal.

Numerous methods have been devised for coating the surface of one metal with a second metal to provide desirable characteristics such as enhanced corrosion resistance and improved mechanical properties. Such composite materials and their method of production are well known in the art and include: hot-dipping, electroplating, co-extrusion and vapor deposition. Powdered metals can be used to prepare metal coatings by methods such as slurry coating and flame spraying. With the exception of the vapor deposition process, all of these methods generally provide relatively thick coatings.

In the process described in U.S. Pat. No. 2,840,890, lead is coated on the surface of a metal wire by drawing the metal wire through an admixture of powdered lead, calcium stearate, and common soap. The lead coated wire is used in the as-drawn condition without further post-drawing operations, i.e., sintering. This type of coating is intended to serve as a lubricant during subsequent cold-forming operations such as for the cold-heading of fasteners.

In accordance with the present invention, metal flake powder is used in place of a lubricant in an otherwise conventional wire drawing operation. The metal flake powder is drawn through a drawing die concurrent with the wire being drawn and mechanically adheres to the surface of the wire. The metal flake powder is subsequently metallurgically bonded to the surface of the wire by a sintering operation in a conventional furnace having a protective atmosphere.

Generally speaking, the present invention is directed to a method for producing a metal coated metal wire comprising the steps of drawing a metal wire while in contact with a surface lubricated metal flake powder to form a green-coat wire, and sintering said green-coat wire to metallurgically bond said metal flake powder to said metal wire to provide said metal coated metal wire.

The metal flake powder can be a milled metal powder prepared in the presence of a lubricant. For example, the fatty acid stearic acid dissolved in mineral spirits was used to prepare the stainless steel, nickel, and other flake powders described in U.S. Pat. No. 3,709,439. Other lubricants that can be used to prepare surface lubricated metal flake powders suitable for the practice of the present invention include other fatty acids such as oleic acid, as well as camphor, paraffin, rosin and synthetic thermoplastic resins. Organic lubricants are generally used since they decompose during the sintering operation and do not lend appreciable residue.

No special preparation of the metal wire surface is required other than that it should be reasonably clean and free from surface dirt and oxides to avoid interruption of coating continuity. Conventional pickling sequences have been found to be useful for providing the desired degree of cleanliness.

The sintering temperature of the metal flake powder should be substantially below the solidus temperature of the metal wire being coated. To illustrate, for the copper coating of steel by the process of this invention, a sintering temperature of 650° C can be used. Similarly, for the nickel coating of steel, a sintering temperature of 760° C can be used.

A suitable, dry, inert or reducing atmosphere is generally required during the sintering operation. Generally this atmosphere corresponds to that required for the sintering of the particular metal flake powder. For example, sintering of nickel flake onto the surface of a 36% nickel, balance iron alloy wire can be effected by exposure for 1 hour at 815° C in hydrogen gas having a −40° C dew point. In a continuous operation, the length of the furnace should be long enough to allow the metal flake coating to be heated to the sintering temperature for a time period sufficient to insure sintering and bonding to the metal wire.

The metal wire to be coated is generally passed through metal flake powder contained within the lubricant holding box of a conventional draw bench and then drawn through a conventional drawing die contained within a drawing block. During passage through the die, the metal flake powder coats the wire while serving as a lubricant to provide a green-coat wire. The metallic flakes have a thin residual layer of lubricant, e.g., stearic acid, upon their surface due to the prior manufacturing operation. In a preferred embodiment, the metal flake powder can be cleaned by washing in a suitable solvent, e.g., trichloroethane, acetone, etc. This treatment serves to substantially remove contaminants that can impede sintering and bonding without providing a negative effect on the lubricating characteristic associated with the powdered metal flake.

The elongated, flat shape of metallic flake powders aids the introduction of the flake powders to the die opening and promotes their adherence to the wire surface. The metal flake powder should be prepared from an elemental or alloyed powder having a U.S. standard sieve size less than about 325 mesh. Following attrition, the metal flake should have a US standard sieve size less than about 100 mesh, and the thickness of the flakes should be less than about 1 micron and preferably between about 0.8 and 0.2 micron.

Mechanical deformation resulting from the drawing operation imparts strain energy to the flake and to the surface of the wire. The mechanical deformation provides a green bond between the metal powder particles and substrate which promotes resistance to wearing away of the metal powder coating during handling prior to the sintering operation. Metallurgical bonding between the flake and wire substrate occurs during the sintering operation as a result of interdiffusion.

Following coating, the green-coat wire is passed through a conventional furnace having a dry, inert or reducing atmosphere. Exposure to this atmosphere at an elevated temperature results in densification and sintering, as well as metallurgical bonding of the coating to the wire surface.

Subsequent to sintering, the coated wire can be coiled for shipment or subjected to additional wire drawing operations or recycled, i.e., as a step toward providing a thicker or multi-layered coating. In regard to multilayer coatings, it is contemplated that layers of individual, different metals can be imparted to a wire surface to promote formation of an alloyed surface layer, e.g., copper-nickel.

Although the metal wire is generally passed through a single lubricant holding box and die, more than one coating station can be used, e.g., tandem lubricant holding boxes and dies. Also, green-coat wire can be given one or more additional passes through the metal flake and drawing dies so that a multiple green-coat wire is prepared and subsequently sintered.

The coating provided by the process of this invention is extremely thin. Attempts to measure coating thickness by conventional, as well as sophisticated, techniques have been unsuccessful. The coatings provided by this invention are believed to be less than about 1 micron thick. Although the coating is extremely thin, it can provide enhancement in such properties as corrosion resistance, electrical conductivity, etc. This can be attributed, to a large extent, to an interdiffusional effect between coating and substrate. When used to coat wire for general use or for welding, the coating provides suitable protection from rusting in an industrial atmosphere. A thin coating of bronze, brass, or nickel on steel wire can be used in tire construction to afford a high level of rubber-to-steel cord adhesion. Also, it is contemplated that the process of this invention can be used to prepare catalytic structures where an expensive catalytic substance (e.g., the platinum metals) is coated on the surface of an inexpensive wire substrate.

Although it is preferred to use the process of this invention for preparing coatings of nickel, nickel alloys, iron, cobalt, copper, brass, bronze, stainless steel, the platinum metals, nickel-silver alloys, aluminum, and aluminum alloys on the surface of wire substrates including steel, stainless steel, nickel-base alloys, copper, copper-base alloys, aluminum, and aluminum-base alloys, the process may be used to coat virtually any metal flake powder upon the surface of any metal wire. Compatibility of the flake and wire is dependent on a capacity for metallurgical bonding between the two and the requirement that the sintering temperature of the flake be lower than the melting point of the wire.

For the purpose of giving those skilled in the art a better understanding of the invention and/or a better appreciation of the advantages of the invention, the following illustrative examples are given:

EXAMPLE I

A 1.6mm diameter wire, nominally containing 36% nickel, balance iron, was coated with a nickel flake powder. The −325 mesh nickel flake had been milled in a conventional attritor operating at 130rpm for 4½ hours in a mixture of mineral spirits and stearic acid. The attritor contained 1140 kilograms of 7mm diameter balls. The liquid to powder ratio (volume) was 35:1, and the ball to powder ratio (weight) was 40:1. The nickel flake powder had an average thickness of about 0.3 microns.

The milled nickel flake was washed in trichoroethane, dried and placed in the lubricant holding box of a conventional draw bench immediately adjacent to the 1.6mm diameter wire drawing die. The wire was drawn through the drawing die without the use of a supplemental lubricant. The drawing operation was readily accomplished without substantial increase in wire temperature, the nickel flake serving as a lubricant. Nickel flake was firmly adhered to the surface of the wire following this treatment. The coating was sintered in place by heating to 760° C in hydrogen for one hour. Also, some of the green-coat wire was sintered at 980° C in hydrogen for one hour.

The nickel coated wire was subsequently coated a second time in the same manner by passing a portion through nickel flake powder and drawing through a 1.5mm diameter drawing die. Sintering treatments were imposed to bond the flake to itself as well as to the surface of the 36% nickel, balance iron wire. Sintering was accomplished during exposure of batches of wire in a hydrogen atmosphere for a period of one hour. Temperatures of 760° and 980° C were examined and found to provide excellent metallurgical bonding of the nickel flake to itself and to the surface of the 36% nickel, balance iron wire.

The wire had a bright silvery appearance following sintering. However, this appearance was essentially identical to that of the wire prior to the coating operation. Optical microscopic examination of transverse cross sections of the wire did not serve to confirm the presence of a nickel coating due to the thinness of the coating.

To test for the presence of a coating, representative sample lengths, e.g., 8cm lengths, of uncoated and coated wires were immersed for a 16-hour period in a saturated solution of sodium chloride in water. The uncoated samples exhibited rust staining, whereas all of the coated samples were free from rust staining, pitting, and other forms of corrosive attack. This simple test demonstrated the presence of the coating formed by the process of this invention and also showed the continuity of the coating.

Further tests of sample lengths involved atmospheric exposure for a two-year period in an industrial environment. There was no evidence of rusting or other form of corrosive attack on the surface of the nickel coated 36% nickel, balance iron wires. An uncoated control sample of the 36% nickel, balance iron wire exhibited extensive rusting during this exposure period.

Wire coated in the manner illustrated by this example can be used as a welding filler metal. The presence of the thin layer of nickel upon the surface of the wire serves to substantially prevent oxidation during storage which, if allowed to occur, could cause improper contact in the welding machine with resultant arcing and wear of the drive rolls.

EXAMPLE II

This example illustrates the use of the process of this invention for applying a nickel coating to the surface of a steel wire.

Low carbon steel wire of 1.6mm diameter was coated with a −325 mesh nickel flake produced by attriting nickel powder in the presence of stearic acid and mineral spirits using the conditions described in Example I.

The nickel flake was placed in the lubricant holding box of a conventional draw bench, and the steel wire drawn first through the nickel flake and then through a 1.6mm diameter die. No lubricant other than the nickel flake was present in the lubricant holding box. Following drawing, the nickel flake was sintered to itself and to the steel wire by placing the coil of green-coat wire in a hydrogen furnace operating at 650° C for a time period of one hour. A portion of the wire prepared in this manner was set aside for subsequent evaluation.

The sintered wire was reintroduced to the draw bench and again passed through nickel flake contained in the lubricant holding box and drawn through a 1.5mm diameter die to apply a second layer of nickel flake. The green-coat wire was given a sintering treatment in a hydrogen atmosphere at 760° C for one hour. A portion of the wire prepared in this manner was set aside for subsequent evaluation.

The balance of the wire was given a third coat of nickel by passing it through the nickel flake contained within the lubricant holding box and a 1.4mm diameter drawing die. The steel wire prepared with a third coat of nickel was sintered in a hydrogen furnace at a temperature of 980° C for a time period of one hour.

The completed 1.6mm, 1.5mm, and 1.4mm diameter wires were visually inspected and found to have uniformly shiny appearances with no evidence of coating discontinuity. Qualitative rubbing tests and bend tests showed that the coatings were firmly sintered to the wire surface.

A test for the presence of a coating on each of the three wires involved immersion of representative lengths of the three wires in a saturated solution of sodium chloride in water for a 16-hour period. No rust staining was observed on the coated samples, whereas a control sample of uncoated steel wire exhibited severe rusting as well as discoloration of the test solution.

The presence of a continuous coating upon the surfaces of the three wires was further confirmed by potentiostatic anodic polarization tests in 10% sulfuric acid solution in water at 25° C. The samples subjected to the potentiostatic test were prepared by forming a sufficient length of the wire in a coil of about 1cm diameter to provide a surface area of 10 square centimeters. The potentiostatic curve for the coated wire was substantially different from the curves established for steel and nickel standards, thereby showing the presence of a coating.

The usefulness of the coating of this invention was demonstrated by exposure of the coated wires in air in an industrial environment for a time period of two years without surface rusting, whereas bare steel wire exhibited extensive rusting under these same conditions.

EXAMPLE III

Copper flake was used to coat the surface of a 1.6mm diameter low carbon steel wire. The commercially produced, −325 mesh size copper flake having an average thickness of 0.57 microns had been milled in the presence of a lubricant; however, the lubricant is not known, nor are the processing conditions.

The copper flake was placed in the lubricant holding box of a conventional draw bench and the steel wire passed through the copper flake and drawn through a 1.6mm diameter die. Following drawing, a coil of the green-coat wire was placed in a furnace with a hydrogen atmosphere operating at a temperature of 650° C for a time period of one hour. A portion of the sintered wire was set aside for evaluation, and the balance of the coil was redrawn.

In the redrawing operation, the 1.6mm diameter coated wire was passed through the lubricant holding box containing copper flake and a 1.5mm diameter drawing die. The twice-coated steel wire was resintered in an identical manner to that previously described for the first coat.

Following sintering, the coated wires were measured and found to be 1.6mm diameter and 1.5mm diameter for the single and double coated conditions, respectively. The coating was again extremely thin and could not be measured by available techniques. The presence and continuity of the copper coating on the mild steel wire was readily apparent due to the difference in the coloration of copper and steel. The steel wires, which formerly had a silvery appearance, had a distinct and uniform copper color over their entire lengths. The uniformity of the color of the coated wires was indicative of the continuity of the copper layer.

Electrochemical potentiostatic measurements in a 10% lactic acid solution at 25° C showed characteristics for the coated wire distinct from that of copper and of steel and demonstrated the presence of a coating on the surface of the steel wire.

Coils of the copper coated steel wire were exposed to the air in an industrial environment for a time period of about one year without showing surface rusting or any other signs of corrosive attack. Uncoated wire exhibited extensive surface rusting under these same conditions. This illustrated the usefulness of a coating as applied by the process of this invention for protection of a substrate alloy to corrosive attack in an industrial environment.

Although electroplated copper is currently used for the preparation of an atmospheric corrosion resistant layer on iron-base welding wires, the use of electroplated copper is not entirely satisfactory since overly thick coatings can lead to weld deposit cracking in some alloys. In addition, the disposal of spent copper-plating electrolyte entails considerable expense. The process of the present invention provides an alternate method for protecting ironbase welding wire from atmospheric corrosion.

EXAMPLE IV

A commercially produced bronze flake containing about 70% copper, 17% zinc, and 13% lead and believed to have been milled in the presence of stearic acid was used to coat a 36% nickel, balance iron alloy wire. The bronze flake had an average thickness of 0.68 microns.

The bronze powder was placed in the lubricant holding box of a conventional draw bench and the 1.6mm diameter wire passed through it and drawn through a 1.6mm die. The wire was subjected to a one-hour sintering treatment in a hydrogen atmosphere at 480° C. About half of this wire was once again passed through the bronze flake and drawn through a 1.5mm diameter die to provide a reduction of about 6%. The cold drawn wire was subjected to a second sintering treatment at 480° C in a hydrogen environment for one hour.

The presence of a coating on the surface of the two wires was established visually. The coating had a uniform and continuous appearance, and the sintered coating could not be removed by rubbing the surface of the wires.

The bronze coated wires were subjected to exposure in an industrial environment for a period of one year without showing any signs of rusting or other forms of corrosive attack. Uncoated wires exhibited extensive surface rusting under these same conditions. This simple exposure demonstrated the continuity of the coating and the usefulness of the coating method for substantially preventing corrosive attack in an industrial environment.

EXAMPLE V

The surface of a 5.1mm diameter copper wire was coated with an aluminum flake. The aluminum flake was prepared in accordance with U.S. Pat. No. 3,776,473 by ball milling in the presence of oleic acid and mineral spirits.

The aluminum flake was placed in the holding box of a conventional draw bench, and the copper wire passed through it and a 4.7mm diameter drawing die. The wire was subjected to a sintering treatment at 370° C for one hour in a hydrogen atmosphere. About half of the wire was set aside for testing.

The balance of the wire was passed once again through the aluminum flake and drawn through a 4.7mm diameter drawing die. The wire was subjected to a sintering treatment at 370° C for one hour in a hydrogen atmosphere.

The presence of a thin aluminum coating on the surface of the copper wires was established by observation of a distinct pink-colored surface layer. Both wires were uniformly coated.

Electrochemical studies with a potentiostat in a 10% lactic acid solution at 25° C showed the presence of a coating on the copper wires which led to different electrochemical characteristics from those exhibited by aluminum or copper.

EXAMPLE VI

Copper flake was used to coat the surface of a 3.2mm diameter commercially pure aluminum wire. The commercially produced copper flake had an average thickness of 0.57 microns.

The copper flake was placed in the lubricant holding box of a conventional draw bench and the aluminum wire passed through the copper flake and drawn through a 2.8mm diameter die. A portion of the green-coat wire was placed in a furnace with a hydrogen atmosphere at a temperature of 480° C for one hour.

In the second drawing operation, the 2.8mm diameter green-coated wire was redrawn through the lubricant holding box containing copper flake and a 2.5mm diameter drawing die. The twice-coated aluminum wire was sintered in a furnace with a hydrogen atmosphere at a temperature of 480° C for one hour.

The coated and sintered wires were measured and found to be 2.8mm and 2.5mm diameter for the single and double coated conditions. The continuity of the coating was determined by visual examination. Prior to sintering, the silvery appearance of the aluminum wire was changed to a uniform copper color. After sintering, the coated aluminum wire had a pink hue. The coating was observed to be continuous over the length of the wires.

Electrochemical potentiostatic measurements in a 10% lactic acid solution at 25° C showed characteristics for the coated wires distinct from that of copper and of aluminum and demonstrated the presence of a coating on the surface of the aluminum wire.

The presence of a layer of copper on the surface of an aluminum wire is believed to be useful for applications involving electrical wiring. It is believed that the copper coating can serve to prevent the build-up of thick aluminum oxide layers between spliced aluminum wires or aluminum wires in contact with mechanical fasteners and thus prevent the formation of "hot-spots" which have been known to cause electrical fires. The presence of a thin copper layer on the surface of aluminum wires is also believed to be useful as a surface suitable for electroplating.

EXAMPLE VII

Low carbon steel wire of 1.6mm diameter was coated with an atomized Type 304L stainless steel flake that had a −325 U.S. standard sieve size prior to processing in an attritor. The stainless steel was attrited in a mixture of mineral spirits and stearic acid. The liquid to powder volume ratio was about 35:1, and the ball to powder ratio was 50:1 by weight. The attritor was operated at 130rpm for 5½ hours.

The steel wire was passed through the stainless steel flake contained within the holding box of a conventional draw bench and drawn through a 1.6mm diameter wire drawing die.

Following drawing, the green-coat wire was sintered at 980° C in hydrogen for one hour. The sintered wire had a uniform shiny appearance.

Atmospheric exposure of the stainless steel coated wire in an industrial environment showed no evidence of rusting or other corrosive attack after a 7-month period, whereas uncoated samples showed extensive rusting under these same conditions.

Wire coated in the manner illustrated by this example can be used as a welding filler metal or as an inexpensive, rust-resistant steel wire for various consumer applications requiring a minor degree of resistance to rust formation.

EXAMPLE VIII

An attempt was made to use a commercially produced substantially spherical −325 mesh nickel powder that had not been milled as well as this same powder after it had been placed, without milling, in a solution of stearic acid and mineral spirits.

A 1.6mm diameter 36% nickel, balance iron wire was passed through the two forms of nickel powder in separate trials. The 1.6mm diameter wire was drawn through a 1.6mm diameter drawing die.

In both cases, only very short lengths of wire could be drawn due to chattering of the wire with eventual tensile rupture. The wire that did pass through the 1.6mm diameter die was extremely hot to the touch showing that conventional powdered metals do not provide the required lubricating function; and furthermore, due to the absence of a green coating of any extent, the conventional powders were not useful for the preparation of coated metal wires.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for producing a metal coated metal wire comprising: passing a metal wire through a coating material consisting of a metal flake powder located adjacent a drawing die, said metal flake powder characterized by an elongate flat shape; drawing said metal wire while in contact with said metal flake powder through said drawing die to mechanically adhere said metal flake powder to said wire to form a green-coat wire; and thereafter sintering said green-coat wire to metallurgically bond said metal flake powder to said metal wire to provide said metal coated metal wire.

2. A process as defined in claim 1, wherein said metal flake powder is a metal powder milled in the presence of of a surface lubricant.

3. A process as defined in claim 2, wherein said surface lubricant is selected from the group consisting of fatty acids, camphor, paraffin, rosin, and synthetic thermoplastic resins.

4. A process as defined in claim 3, wherein said fatty acids are selected from the group consisting of stearic acid and oleic acid.

5. A process as defined in claim 3, wherein said metal powder is selected from the group consisting of nickel, nickel alloys, iron, cobalt, copper, brass, bronze, stainless steel, the platinum metals, nickel-silver alloys, aluminum, and aluminum alloys.

6. A process as defined in claim 5, wherein said metal wire is selected from the group consisting of steel, stainless steel, nickel, nickel-base alloys, copper, copperbase alloys, aluminum, and aluminum-base alloys.

7. A process as defined in claim 6, wherein said metal flake powder has a sintering temperature below said metal wire melting temperature.

8. A process as defined in claim 1, wherein said green-coat wire is passed through a second coating material consisting of a second metal flake powder located adjacent a second drawing die, said second metal flake powder characterized by an elongate flat shape; drawing said green-coat wire while in contact with said second metal flake powder through said second drawing die to mechanically adhere said second metal flake powder to said green-coat wire.

* * * * *